United States Patent [19]

Miller

[11] 4,230,162

[45] Oct. 28, 1980

[54] WOOD WORKING MACHINE

[75] Inventor: Robert M. Miller, Denver, Colo.

[73] Assignee: Denver Wood Products Company, Denver, Colo.

[21] Appl. No.: 973,941

[22] Filed: Dec. 28, 1978

[51] Int. Cl.[3] ..... B27C 9/04

[52] U.S. Cl. ..... 144/3 R; 29/26 A; 144/20; 144/325; 144/326 R; 144/92; 408/36; 408/49; 408/62

[58] Field of Search ..... 408/50; 408/52; 29/26 A; 144/3 R, 1 R, 3 G, 4, 15, 16, 18, 20, 48, 92, 97, 323, 325, 326 R; 408/36, 37, 44, 49, 50, 52, 53, 62, 87

[56] References Cited

U.S. PATENT DOCUMENTS

| | | | |
|---|---|---|---|
| 1,133,243 | 3/1915 | Hill | 408/49 |
| 1,553,602 | 9/1925 | Edwards et al. | 408/49 |
| 2,678,694 | 5/1954 | Homann | 408/49 |
| 3,797,542 | 3/1974 | Wood | 144/3 R |
| 4,061,437 | 12/1977 | Strange et al. | 408/53 |

FOREIGN PATENT DOCUMENTS

| | | | |
|---|---|---|---|
| 517256 | 12/1920 | France | 144/20 |
| 162 | of 1854 | United Kingdom | 144/20 |

*Primary Examiner*—W. Donald Bray

*Attorney, Agent, or Firm*—Sheridan, Ross, Fields & McIntosh

[57] ABSTRACT

In accordance with this invention a wood working machine is provided which facilitates the sequential working of opposite sides of a wooden work piece to form a flange for a cable reel. The work piece is grippingly held against a work piece support while the support moves downwardly to permit working on one side of the work piece with a first set of working elements and then moves upwardly to permit working on the other side of the work piece by a second set of wood working elements after which the support returns to its initial position and the work piece is released for removal from the apparatus.

5 Claims, 11 Drawing Figures

WOOD WORKING MACHINE

DESCRIPTION

CROSS REFERENCE TO RELATED APPLICATION

This application relates to a wood working machine for use in constructing the flange of the reel disclosed in U.S. Patent Application Ser. No. 816,982, filed June 19, 1977 and now abandoned.

DISCLOSURE OF INVENTION

A machine for sequentially performing work operations on opposite sides of a work piece is provided. The machine includes a vertically moveable work piece support and clamping means for holding the work piece on the support while it is being worked. The machine also includes a first wood working element mounted below the support and a second wood working element mounted above the support. Drive means is provided for moving the support from a rest position between the first and second wood working elements up and down so that it is first worked on one side by one of the wood working elements and then worked on the opposite side by the other wood working element before coming back to the rest position.

More particularly, the wood working apparatus of this invention includes a work piece support in the form of a table mounted for vertical movement along a pair of spaced rods. A work piece is clampingly held against the work piece support by a pair of solenoid activated pivotal arms which are moved into juxtaposition with the work piece support to hold a work piece between the arms and the support. A first wood working element having drills and counterbore routers is mounted below the work piece support and a second wood working element comprising a central drill and routing knives are mounted above the work piece element. Control means are activated to energize both the first and second wood working elements as well as the solenoid operated clamp arms so that the work piece is clamped to the work piece support table. Simultaneously, a drive means is energized which moves the work piece support table downwardly until the first wood working elements engage and perform their wood working operation on one side of the work piece whereupon the work piece support table then moves upwardly so that the second wood working elements can perform their wood working operation on the second side of the work piece, the table finally coming to rest between the upper and lower positions at a rest position whereupon the drive means and the wood working elements and the clamping arms are all deactivated so that the work piece can be removed. Conveniently, the drive means includes an eccentric comprising a fly wheel and a push rod for causing the vertical reciprocal motion of the work piece support table. In addition, a switch is operated by the fly wheel to deenergize the drive means as soon as the apparatus has gone through one complete cycle.

BEST MODE FOR CARRYING OUT THE INVENTION

Figure 1:
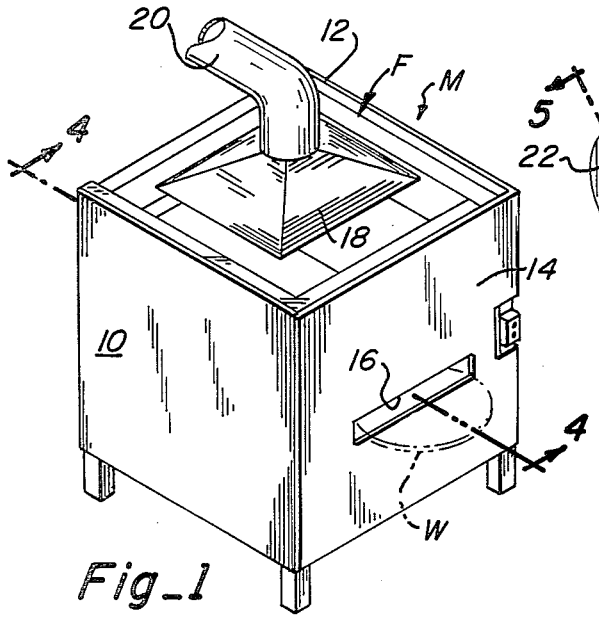
FIG. 1 is a perspective view of an apparatus constructed in accordance with this invention.
Figure 6:
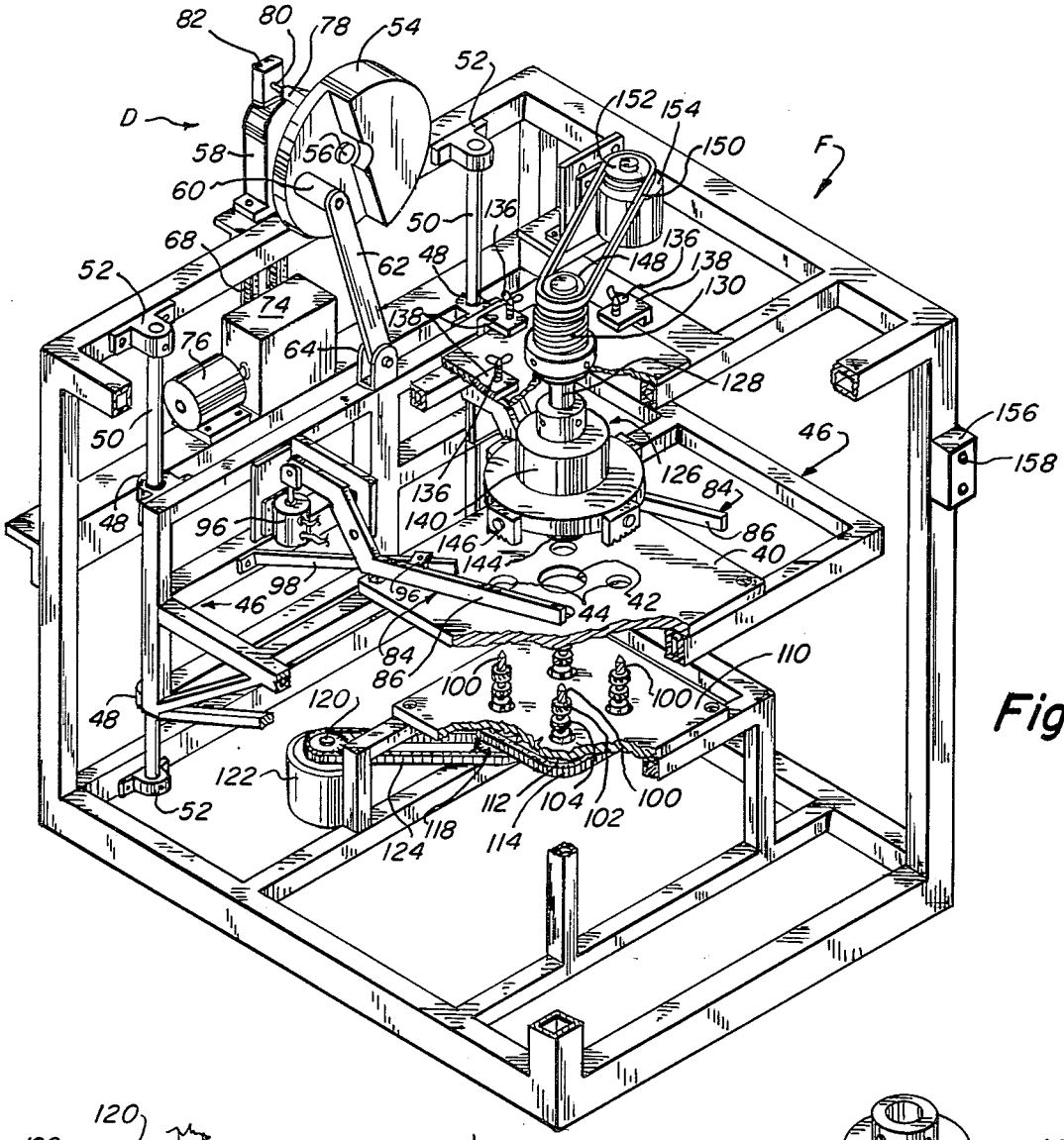
FIG. 6 is a perspective view, with parts broken away for clarity of illustration, of the apparatus of FIGS. 1 and 4.

In accordance with this invention a wood working machine M is provided as best seen in FIGS. 1 and 6 which comprises a metal tubular frame F that supports the various internal mechanisms to be described as well as side wall panels 10 and 12 and front wall panel 14. Conveniently, the front wall panel has an opening or slot 16 through which a work piece W, more fully described below, may be inserted into the machine. Conveniently, a hood 18 is positioned over machine M and is connected to an exhaust duct 20 through which wood particles and other debris from the wood working process can be removed.

Figure 2:
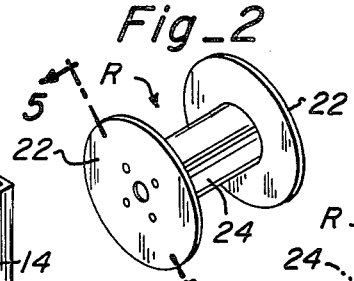
FIG. 2 is a perspective view of a cable reel having flanges of the type constructed on the apparatus of FIG. 1.
Figure 3:
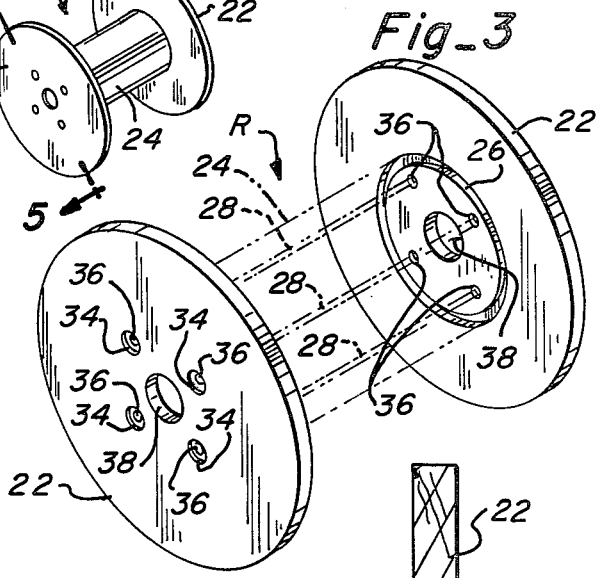
FIG. 3 is an enlarged view of the cable reel of FIG. 2 with the center drum shown in phantom in order to illustrate details of the wood working procedures which are required on the flanges.

The machine of FIG. 1 is used for producing the flanges 22 of reel R, shown best in FIGS. 2 and 3. These reels are used for storing and dispensing electrical cable and their construction is more fully disclosed in my copending U.S. Application Ser. No. 816,982, filed June 19, 1977, now abandoned. The flanges are interconnected by a drum 24 which is received in a concentric groove 26 on the interface of each flange 22. The entire reel assembly is held together by spaced rods 28 which include enlarged heads 30 bearing against washers 32 within a counterbore 34 of spaced holes 36 formed in the flanges. The flanges also include a central opening 38 for rotatably mounting the reel on a rod or spool (not shown). A flange blank, which is merely a flat circular disc having a diameter of the size required for the reel is inserted into machine M as a work piece W whereupon holes 36 and counterbores 34 are formed on the outer face thereof and concentric groove 26 and central bore 38 is formed on the interface thereof.

The work piece is supported on a work piece support or table 40. This table has a central large opening 42 and four smaller openings 44 spaced therearound. These correspond to central opening 38 in the flange and holes 36 and counterbores 34, respectively, for providing space for the wood working elements or tools to pass through the table and the work piece. Table 40 is mounted on a tubular metal support 46. A pair of spaced bearings 48 are mounted adjacent opposite ends of support 46 for vertical movement along rods 50 which are attached to frame F by blocks 52 at opposite ends thereof. Vertical reciprocal movement of support 46 and hence, work piece support table 40 is accomplished through a drive means D which includes an eccentric comprising fly wheel 54 mounted on one end of a horizontal shaft 56 whose other end is mounted in a block 58 on frame F. An arm 60 is mounted eccentrically on fly wheel 54 and is pivotally connected to one end of a push rod 62 whose other end is pivotally mounted in a bracket 64 on support 46.

Figure 4:
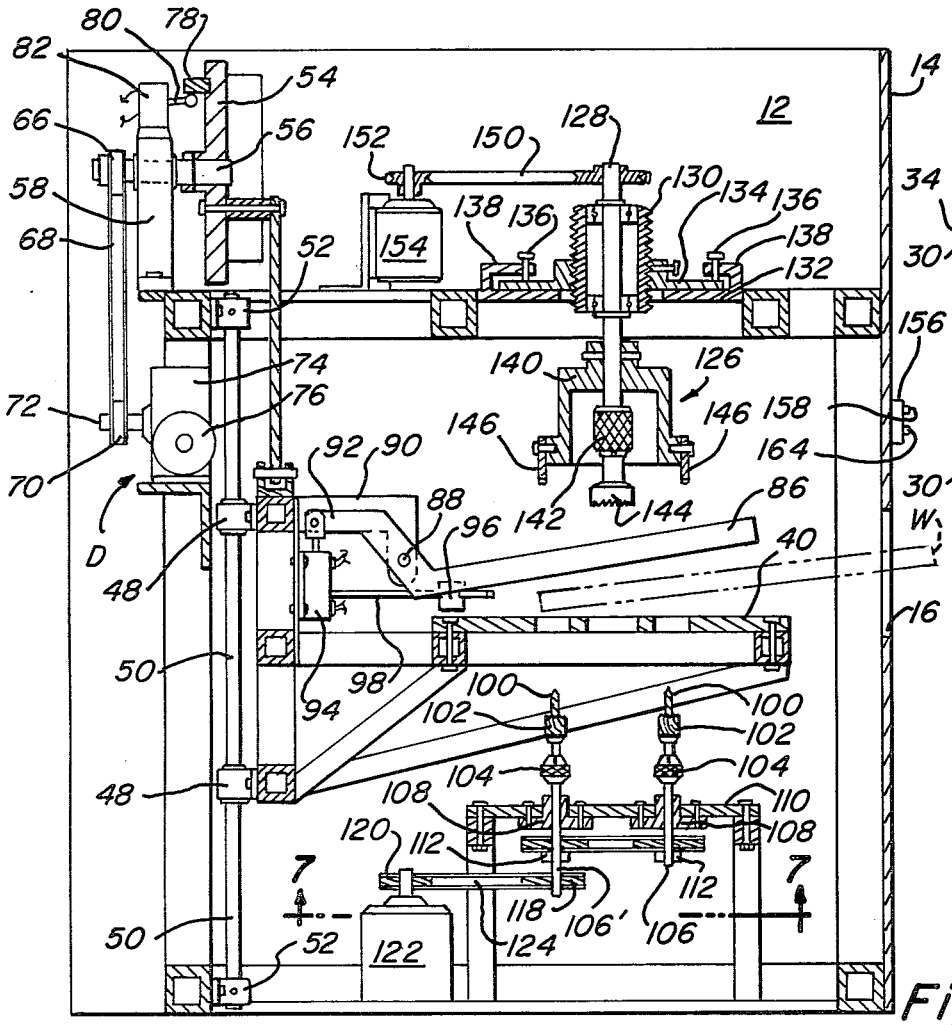
FIG. 4 is an enlarged vertical section taken along line 4—4 of FIG. 1, showing the work piece support table in its initial position.
Figure 5:
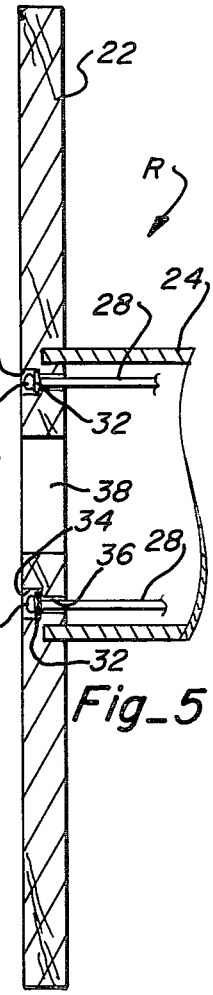
FIG. 5 is a greatly enlarged transverse section, taken along line 5—5 of FIG. 2 showing how the drum of the cable reel fits onto a flange and is held in place.

As can readily be seen, rotation of the fly wheel will cause reciprocal vertical movement of support 46 and work piece support table 40. Conveniently, fly wheel shaft 56 has a pully 66 mounted on the outer end thereof, as best seen in FIG. 4, over which a belt 68 extends, the belt also going over a pully 70 mounted on a shaft 72 to a gear box 74 which in turn is connected to motor 76 for operating the drive means. Conveniently, an arm 78 extends from the back of the fly wheel and is adapted to engage an arm 80 of a switch 82 for deenergizing the drive means, as more fully discussed below.

A pair of clamping arms 84 are each pivotally mounted on support 46 as best seen in FIGS. 4 and 6. Each arm includes a clamping member 86 extending over table 40 and has a pivotal connection 88 to a bracket 90 on frame 46 and a rearwardly extending actuator arm 92 which is pivoted, as by energization of solenoid 94, to cause clamping member 86 to grip a work piece W between it and table 40. The clamping arm 84 will be pivoted in an opposite direction to release clamping member 86 from the work piece so that it can be removed when solenoid 94 is deenergized.

Conveniently, the work piece is positioned by means of a pair of stops such as stop 96 shown in FIGS. 4 and 6, which is adjustable along a rod 98 to accommodate different diameter work pieces. Thus, the wood working machine M of this invention may be used for cutting flanges of different diameter for use on different size reels.

Figure 7:
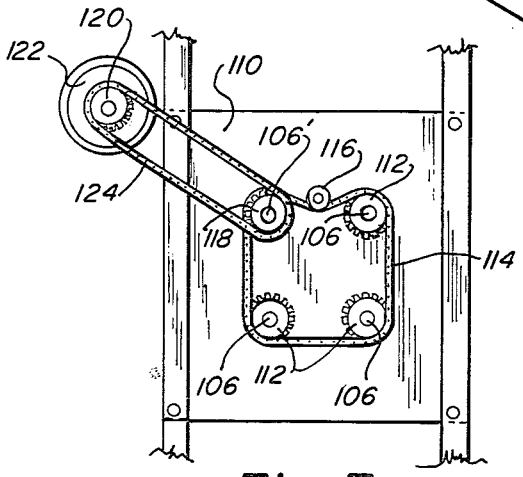
FIG. 7 is a bottom plan view, taken along line 7—7 of FIG. 4, showing the drive mechanism for operating the lower working element.
Figure 8:
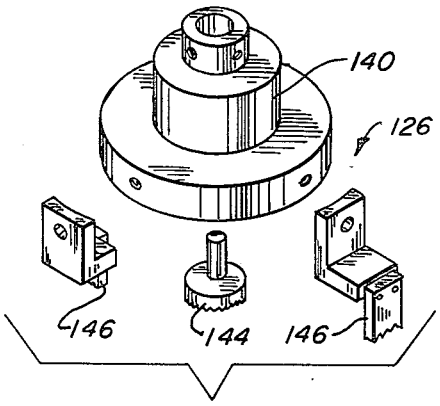
FIG. 8 is an enlarged perspective view of the upper wood working element of FIG. 6 showing further details thereof.
Figure 9:
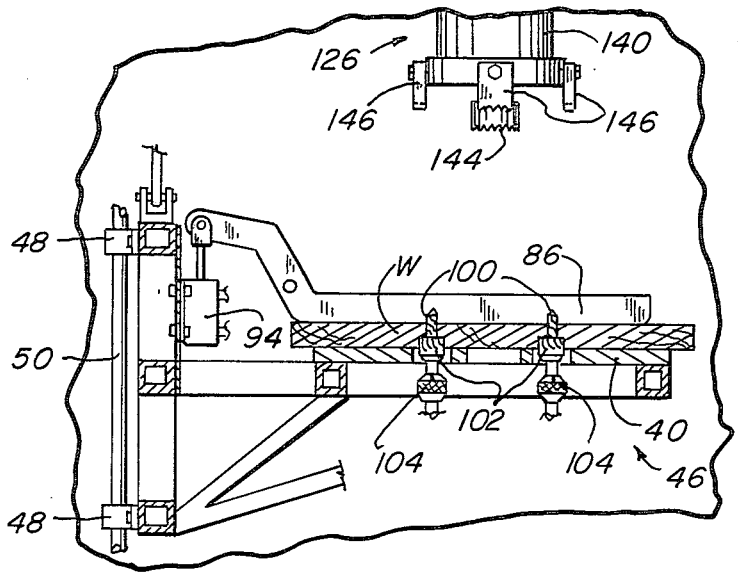
FIG. 9 is a side elevation of a portion of FIG. 4 showing the work piece support table and lower position.
Figure 10:
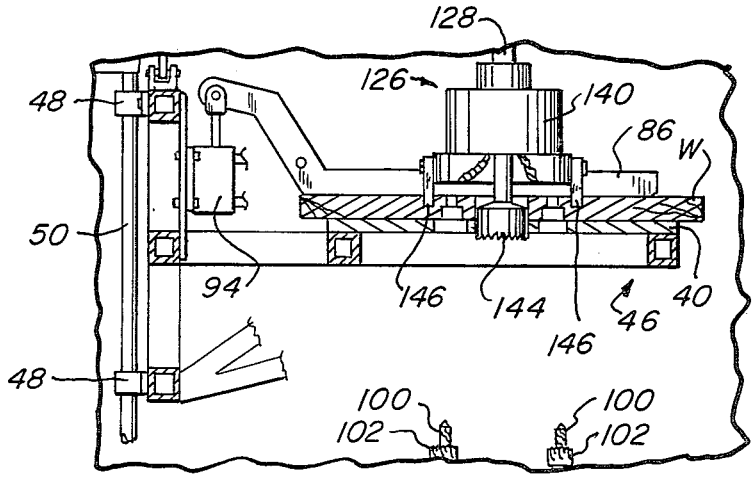
FIG. 10 is a side elevation, similar to FIG. 9, but showing the work support table in the upper position.

Mounted below the table, each bit has a counterbore router 102 surrounding it for cutting counterbores 34. The drill bits are each mounted in a chuck 104 supported on rotatable shaft 106 in bearing 108 on a lower support plate 110. A cog wheel 112 is attached to each shaft and an endless belt 114 extends around the cog wheels as best seen in FIG. 7. Advantageously, the tension on the belt can be adjusted by means of a roller 116 which bears against the outer side of the belt. The shaft for one of the drill bits, namely shaft 106' is longer than the others and has a second cog wheel 118 which is interconnected with a cog wheel 120 on a motor 122 by means of an endless belt 124. With motor 122 energized, it will be appreciated that when table 40 is lowered with a work piece thereon so that the drill bits 100 and routing tools 102 extend through openings 44 in the table, the drill bits will pass through the work piece forming holes 36 and the routers will form the counterbores 34. This is best illustrated in FIG. 9.

Above support table 40 is a rotatable cutter assembly 126 which is mounted for rotation on a shaft 128 supported in a bearing 130 on an upper support plate 132, as best seen in FIGS. 4 and 6. Conveniently, the cutter assembly can be adjusted upwardly or downwardly by rotating threaded bearing 130 within a threaded fixture 134. As will be apparent, fixture 134 rests on top of upper support plate 132 and is held in place by thumb nuts 136 mounted in spaced angle irons 138, as shown. Thus, the cutter assembly can be adjusted laterally as well as longitudinally over the work piece to the appropriate position and particularly for adjustment to be centered over work pieces of different diameters. The cutter assembly includes a housing 140 which is attached adjacent the lower end of shaft 128. A chuck 142 for holding a cutter 144 which cuts the center opening in the work piece is attached to the lower end of the shaft. A plurality of knives 146 are attached to the outer edges of the housing for routing the concentric groove 26 in the work piece.

Shaft 128 has a pully 148 attached to the upper end thereof around which a belt 150 extends which runs to a pully 152 on the shaft of motor 154.

Figure 11:
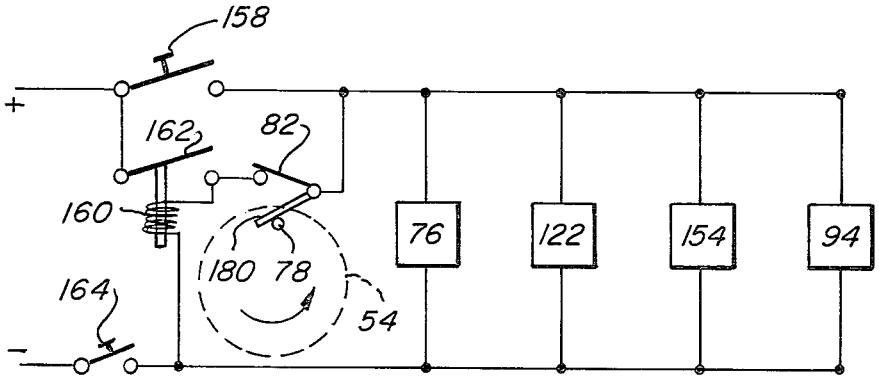
FIG. 11 is a diagramatic showing of the circuitry used in the apparatus of FIG. 1.

To operate the machine, a work piece W is inserted through slot 16 onto table 40 so that the edge thereof engages stops 96 which have been positioned to center the work piece. A switch box is mounted on the side of the machine for operating it. It includes a first switch 158, which is normally open, which when depressed closes the circuit to motors 76, 122, 154 and to solenoid 94. Closing of switch 158 also energizes solenoid 160 of FIG. 11 to close switch 162 which maintains the circuit after switch 158 is released. Thus, when solenoid 94 is activated, clamping arms 84 are pivoted so that clamping members 86 come into engagement with the top of the work piece to hold it securely in place. The energization of motor 76 causes fly wheel 54 to begin rotating in a counterclockwise direction, as viewed in FIG. 6, causing support 46 to move downwardly along rods 50 so that drills 100 will extend through openings 44 in support table 40 and drill holes 36 in the work piece and routers 102 will form counterbores 36. As fly wheel 54 continues to rotate, support 46 will then move upwardly bringing the work piece up against cutter 144 which will drill the center opening 38 in the work piece and against cutting knives 146 which will route out concentric groove 26 in the work piece. Continued rotation of the fly wheel will then bring the support back to its initial position whereupon arm 78 on the back of the fly wheel will contact arm 80 of switch 82 which will cause switch 82 to open, breaking the circuit to motors 76, 122, 154 and to solenoid 94. This will stop the machine and cause clamping arms 84 to be raised so that the work piece can be removed and replaced with another work piece whereupon the operation can be repeated. In case of an emergency, normally closed switch 164 on switch box 156 can be depressed to open the switch thereby breaking the circuit to the motors and solenoid and stopping the apparatus at whatever point in the cycle it may be.

From the foregoing, the advantages of this invention are readily apparent. A machine for sequentially performing work operations on opposite sides of a circular work piece has been provided. The device will first drill holes and counter sink them on one side of the work piece and then form a central opening and a concentric groove on the other side of the work piece to form a flange for a cable reel. To operate the device a work piece is placed on a vertically moveable support table. A switch is closed to activate a clamping arm as well as to energize a drive means which moves the table downwardly causing drill bits and router tools to form the holes and counterbores in the work piece for the flange and then the table moves upwardly so that the other side of the work piece is engaged by a cutting tool that forms a central hole and knives which route out a concentric groove whereupon the table is returned to its initial position by the drive means and the entire mechanism is shut off and the work piece is released by the clamping arms.

The invention has been described in detail with particular reference to preferred embodiments thereof, but it will be understood that variations and modifications can be effected within the spirit and scope of the invention.

I claim:

1. A machine for sequentially performing work operations on opposite sides of a work piece, said machine comprising:

a vertically moveable work piece support;

a clamping means on the work piece support for holding a work piece in position thereon;

first wood working elements mounted below said support;

second wood working elements mounted above said support;

drive means to reciprocatingly move said support from a rest position between said first and second elements up and down between said working elements for performing work operations sequentially on opposite sides of said work piece;

a first solenoid to activate said clamping means; and a switch means connected to the drive means to deactivate the clamping means after movement of said work piece support from said rest position to a lower position for working by said first wood working elements, back through said rest position to an upper position for working by said second wood working elements and back to said rest position, and to release the clamping means.

2. A machine, as claimed in claim 1, wherein said drive means includes:

a fly wheel rotatably mounted on a shaft; and a crank arm having one end connected to the fly wheel and the other end connected to the support so that upon rotation of said fly wheel said support reciprocates up and down.

3. A machine, as claimed in claim 2, wherein said control means includes:

a switch operated by said fly wheel for deenergizing the control means when the machine has gone through one complete cycle.

4. A machine, as claimed in claim 1, wherein;

said first wood working element includes:

a plurality of drill bits and routing tools for drilling holes in the work piece and forming counterbores around the holes; and said second woodworking elements include:

a center cutting tool for cutting an opening in the work piece and a plurality of cutting blades for routing out a concentric groove in the work piece.

5. A machine for sequentially performing work operations on opposite sides of a work piece, said machine comprising:

a vertically moveable work piece support;

clamping means on the work piece support for holding a work piece in position thereon;

first wood working elements mounted below said support;

second wood working elements mounted above said support;

drive means to reciprocatingly move said support from a rest position between said first and second elements up and down between said working elements for performing work operations sequentially on opposite sides of said work piece;

a first solenoid to activate said clamping means;

a switch means connected to the drive means to deactivate the control means after movement of said work piece support from said rest position to a lower position for working by said first wood working elements, back through said rest position to an upper position for working by said second wood working elements and back to said rest position, and to release the clamping means;

a flywheel rotatably mounted on a shaft;

a crank arm having one end connected to the fly wheel and the other end connected to the support so that upon rotation of said fly wheel said support reciprocates up and down; and a switch operated by said fly wheel for deenergizing the control means when the machine has gone through one complete cycle.

* * * * *